United States Patent [19]

Ponomarev

[11] Patent Number: 5,043,059

[45] Date of Patent: Aug. 27, 1991

[54] CONCENTRATOR FOR BENEFICIATING MINERALS

[76] Inventor: Grigory M. Ponomarev, ulitsa Skuridina, 8, kv. 14., Magadan, U.S.S.R.

[21] Appl. No.: 449,855

[22] PCT Filed: Apr. 27, 1988

[86] PCT No.: PCT/SU88/00102

§ 371 Date: Dec. 13, 1989

§ 102(e) Date: Dec. 13, 1989

[87] PCT Pub. No.: WO89/10196

PCT Pub. Date: Nov. 2, 1989

[51] Int. Cl.[5] ..... B03B 7/00

[52] U.S. Cl. ..... 209/44; 209/439; 209/504; 209/506

[58] Field of Search ..... 209/440, 438, 439, 446, 209/504, 506

[56] References Cited

U.S. PATENT DOCUMENTS

| | | | |
|---|---|---|---|
| 666,603 | 1/1901 | Cramer | 209/438 |
| 2,276,044 | 3/1942 | Johnston | 209/44 |
| 2,822,090 | 2/1958 | Johnston | 209/504 |
| 3,507,390 | 4/1970 | Mozley | 209/504 |
| 3,653,505 | 4/1972 | Phippen | 209/44 |
| 4,162,969 | 7/1979 | Lagal | 209/447 |
| 4,273,648 | 6/1981 | Legg | 209/447 |

FOREIGN PATENT DOCUMENTS

| | | |
|---|---|---|
| 700975 | 6/1983 | U.S.S.R. . |
| 809692 | 6/1983 | U.S.S.R. . |

*Primary Examiner*—Robert R. Song

*Attorney, Agent, or Firm*—Fleit, Jacobson, Cohn, Price, Holman & Stern

[57] ABSTRACT

A concentrator comprises a beneficiating member (7) a shaft (9) of which is arranged with an eccentricity relative to the hub (5) of a base (3), and a drive mechanism (2) imparting to the beneficiating member (1) movement about a radius equal to the eccentricity. The housing (14) of the beneficiating member is cylindrical accommodating tapered separating trays (16) arranged one under the other and having by-pass ports (22) of a flow area reducing from the upper to the lower tray.

6 Claims, 6 Drawing Sheets

CONCENTRATOR FOR BENEFICIATING MINERALS

FIELD OF THE INVENTION

This invention relates generally to the mining industry and, more particularly, to a concentrator for beneficiating minerals by gravity.

BACKGROUND OF THE INVENTION

When carrying out such operations it is essential to ensure a high degree of recovery (concentration) of the material being beneficiated, including materials containing large quantities of base minerals, such as pyrite, granite, magnetite. The same degree of recovery is essential during the treatment of initial materials containing high amounts of dust gold. Another requirement is to mechanize the processing stages and reduce labour intensity.

There are known rotary separators for beneficiating minerals, particularly gold (SU, A, 700,975 and 809,692) operating on the principle of concentrating base metals or minerals and comprising a base with a hub, a beneficiating member with a discharge hole, and a drive mechanism. The drive mechanism has the form of a hollow drive shaft journalled in bearings in the base hub and accommodating with an eccentricity in bearings a shaft of the beneficiating member travelling about a circle of a radius equal to the eccentricity. The beneficiating member is fashioned as a bowl having riffles at its inner surface.

However, the degree of concentration of metal, particularly gold, in this separator during beneficiating the initial material containing substantial amounts of gold and thin slices of gold is insuffucuent. For this reason, it is necessary to carry out repeated refining of the product, which makes the operation more labour- and time-consuming. Another disadvantage is the tendency of the bowl riffles to clog under the action of centrifugal forces when large amounts of heavy concentrates are present in the material, which negatively affects the beneficiation process.

SUMMARY OF THE INVENTION

The present invention aims at the provision of a concentrator for beneficiating minerals in which the beneficiating member would be so constructed as to increase the efficiency of the process of concentration of metals and reduce the share of manual labour.

The aims of the invention are attained by that in a concentrator for beneficiating minerals comprising a base with a hub, a beneficiating member with a discharge hole, and a drive mechanism including a hollow drive shaft journalled in bearings in the base hub accommodating with an eccentricity in bearings a shaft of the beneficiating member executing movement about a circle of a radius equal to the eccentricity, according to the invention, the beneficiating member includes a cylindrical housing with tapered separating trays arranged one under the other and having by-pass ports of a flow area reducing from the upper to the lower tray, the cylindrical housing being connected to the base by flexible rods.

The cylindrical shape of the housing with the tapered separating trays arranged one under the other allows, as the material moves from one tray to the other, to reduce its volume, and thereby improve conditions for beneficiation. The tapered shape of the separating trays makes it possible to carry out the final concentration (increase the degree of concentration) in one arrangement to the desired concentration of metal, thanks to that the material being beneficiated tends to concentrate in the recesses of the trays, whereas the gangue and water are evacuated over the edges of the trays. Reducing the flow area of the by-pass ports provided in the trays enables to convey to the underlying tray only the material preliminarily enriched in the overlying tray.

Connection of the cylindrical housing to the base by a flexible rod affords the beneficiating member during its travel about a circle of a radius equal to the eccentricity to execute jolt-like motions facilitating the travel of the material along the trays and ensuring more favourable conditions for separating the material in each of the trays.

Preferably, an additional tray intended to finish the concentrate is connected to the housing of the beneficiating member under the lower separating tray, enabling to finish the concentrate simultaneously with the operation of the separating trays.

The tapered separating trays can be arranged in a stepwise fashion. Such an arrangement ensures a higher concentration efficiency and increases the degree of disintegration and recovery of the meritable constituent, since each underlying tray in this case receives a richer product, whereas the gangue is discharged from each tray to the bottom of the housing serving as effluent collector.

The central part of the housing can be concaved toward the interior of the housing to define a cavity for accommodating the drive mechanism therein. This affords to reduce the size of the concentrator and relieve cantilever loads exerted on the shaft of the beneficiating member and its bearings, thereby providing a higher reliability and longer service life of the concentrator.

Advisably, the trays are provided with circular riffles having ports offset relative to the ports of the adjacent riffles. Such an arrangement allows the particles of metal to move through the ports to the center of the tray failing to be retained at the upper riffles.

According to one preferred embodiment of the proposed concentrator, there is provided a mixing chamber arranged over the additional tray and secured to the bottom of the cylindrical housing, this mixing chamber having an outlet port and communicating with the interior of the housing through the discharge hole and a perforated tube also accommodated inside the housing. Such an arrangement ensures that the liquid phase of the pulp accumulated at the top part of the lower separating tray flows to the mixing chamber to thereby obtain the optimum degree of fluidity of the material being beneficiated prior to its discharge onto the additional tray.

In view of the aforedescribed, the proposed concentrator for beneficiating minerals, as compared with the prior art concentrators, features a higher efficiency when processing mineral samples, requires less water for operation thanks to that the slime sludge is washed without adding water, requires less power for operation, and has a lower weight. The size of the proposed concentrator affords its accommodation on the wing of a drilling rig used for prospecting. The proposed concentrator can carry out the following operations: disintegration, screening, beneficiation of coarse and fine fractions, finishing and flushing the concentrate.

BRIEF DESCRIPTION OF THE DRAWINGS

The invention will now be described in greater detail with reference to a detailed description of various preferred embodiments thereof taken in conjunction with the accompanying drawings, in which.

BEST MODE OF CARRYING OUT THE INVENTION

Figure 1:
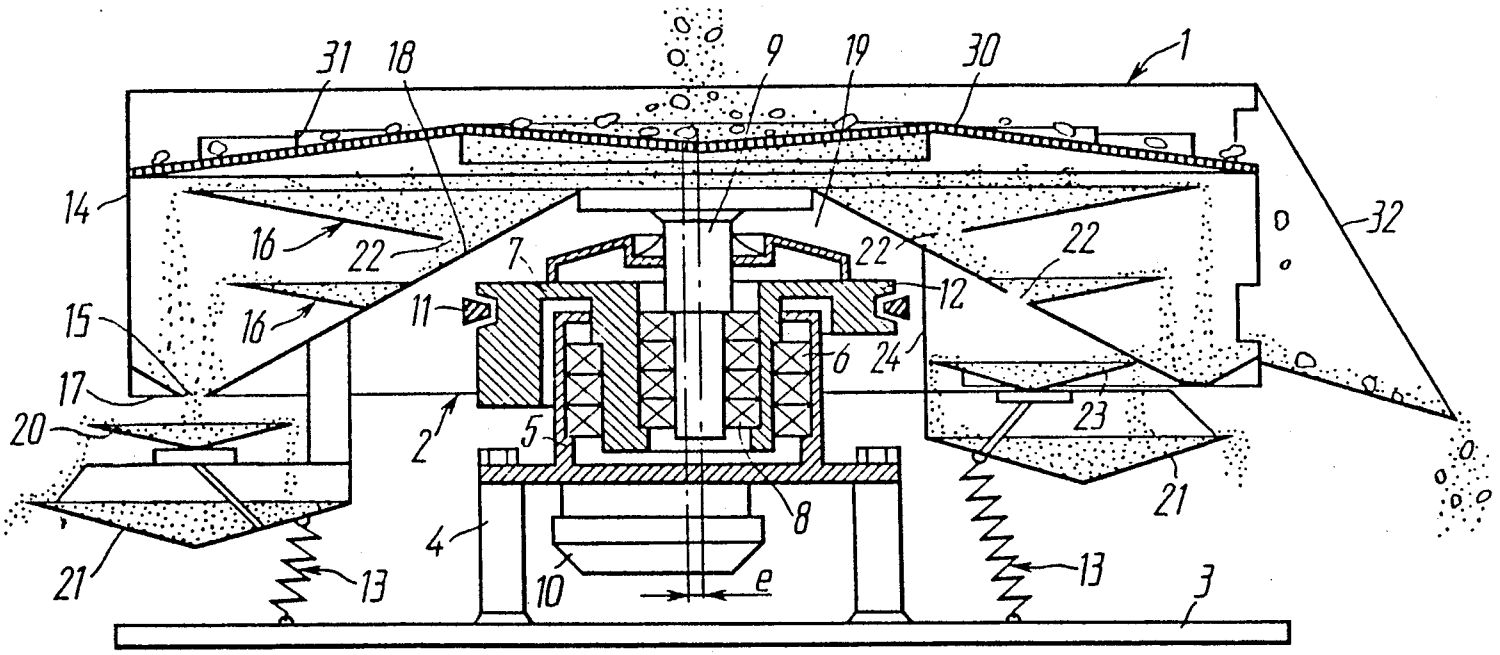
FIG. 1 is a schematic representation of the proposed concentrator having a tapered bottom.

A concentrator for beneficiating minerals comprises a beneficiating member 1 (FIG. 1), and a drive mechanism 2 mounted on a base 3. Secured on the base 3 by means of posts 4 is a hub 5 having a hollow drive shaft 7 of the drive mechanism 2 journalled in bearings 6. The hollow drive shaft 7 accommodates with an eccentricity in bearings 8 a shaft 9 on which the beneficiating member 1 is secured.

The drive mechanism 2 includes an electric motor 10 an output shaft of which is connected through a reducing gear or belt transmission 11, as seen best in FIG. 1, to a pulley 12 of the hollow drive shaft 7. Thanks to the arrangement of the shaft 9 of the beneficiating member with an eccentricity relative to the shaft 7, the beneficiating member moves about a circle of a radius equal to the eccentricity "e" (FIGS. 1 to 4).

For preventing rotation the beneficiating member 1 is connected to the base 3 by flexible rods 13 having the form of springs, cables, flexible plates with rollers received in grooves, or in the form of any other known suitable arrangements. This enables the beneficiating member during its circular travel to execute intermittent jolt-like motions providing favourable conditions for separating the material according to density.

The beneficiating member 1 comprises a cylindrical housing 14 with one or more discharge holes 15, and tapered separating trays 16 accommodated inside the housing 14 one under the other, the diameter of the overlying trays being greater than the diameter of the underlying trays.

The cylindrical housing 14 has a bottom 17 a central part 18 of which has a concavity toward the interior of the housing as shown in FIGS. 1 to 4, the concavity of the bottom 17 being defined by the tapered shape of the bottom, as shown in FIG. 1. In all alternative modifications of the central part 18 of the bottom with reference to FIGS. 1 to 4, it forms a cavity 19 where the drive mechanism 2 is accommodated, which makes the concentrator more compact and reliable in operation. The working space of the housing 14 is of annular configuration, whereas the trays 16, as viewed in plan, have the form of annular bands (FIG. 5).

Figure 2:
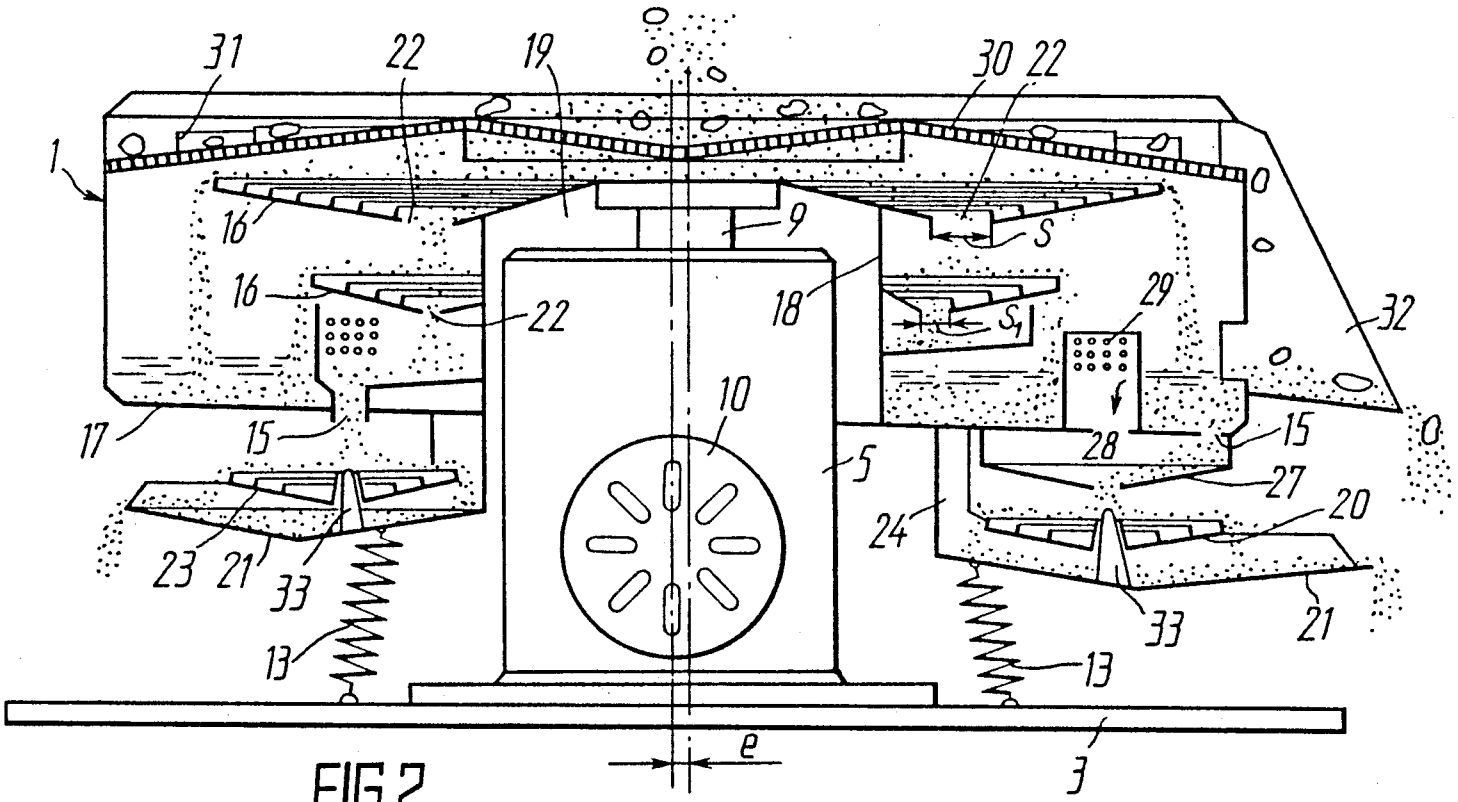
FIG. 2 shows the proposed concentrator with tapered trays secured to the inside wall of a housing.
Figure 3:
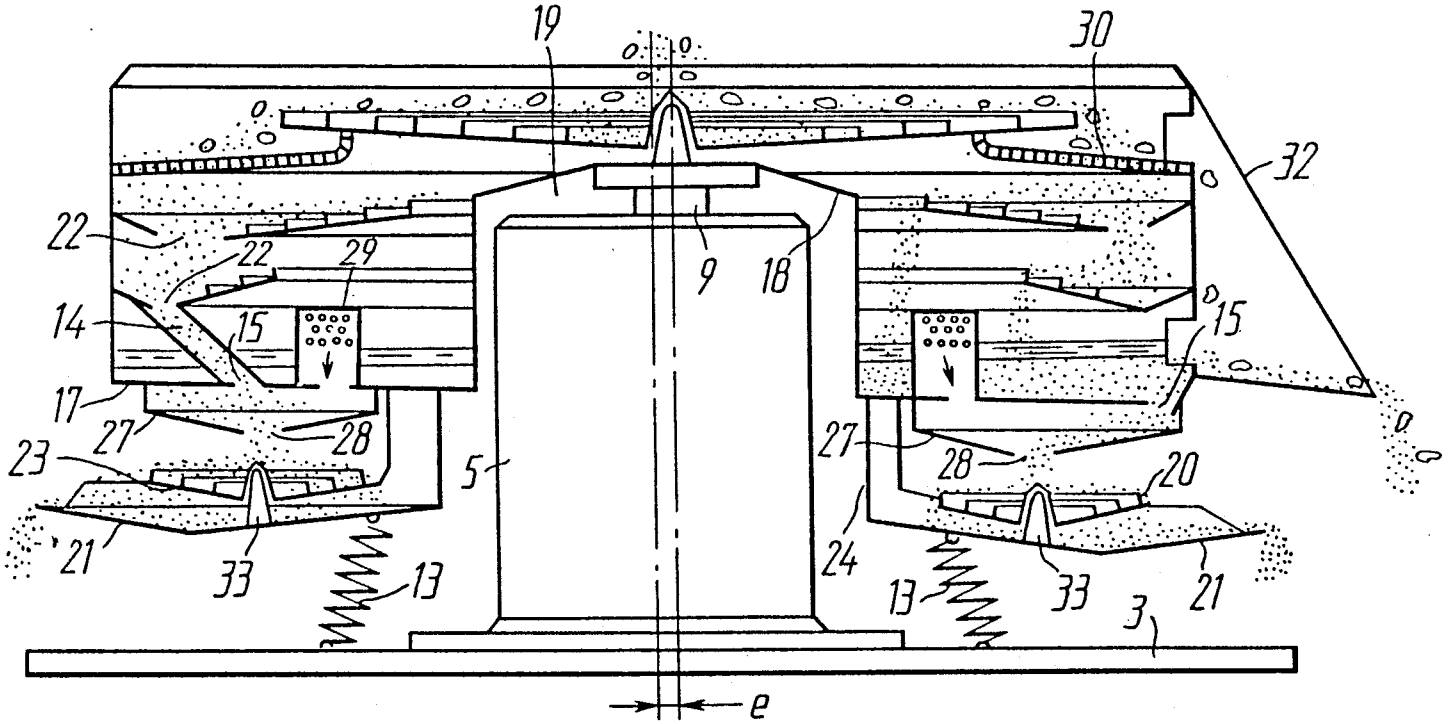
FIG. 3 is a view of the concentrator of FIG. 1 with tapered trays secured to the side wall of the housing.
Figure 4:
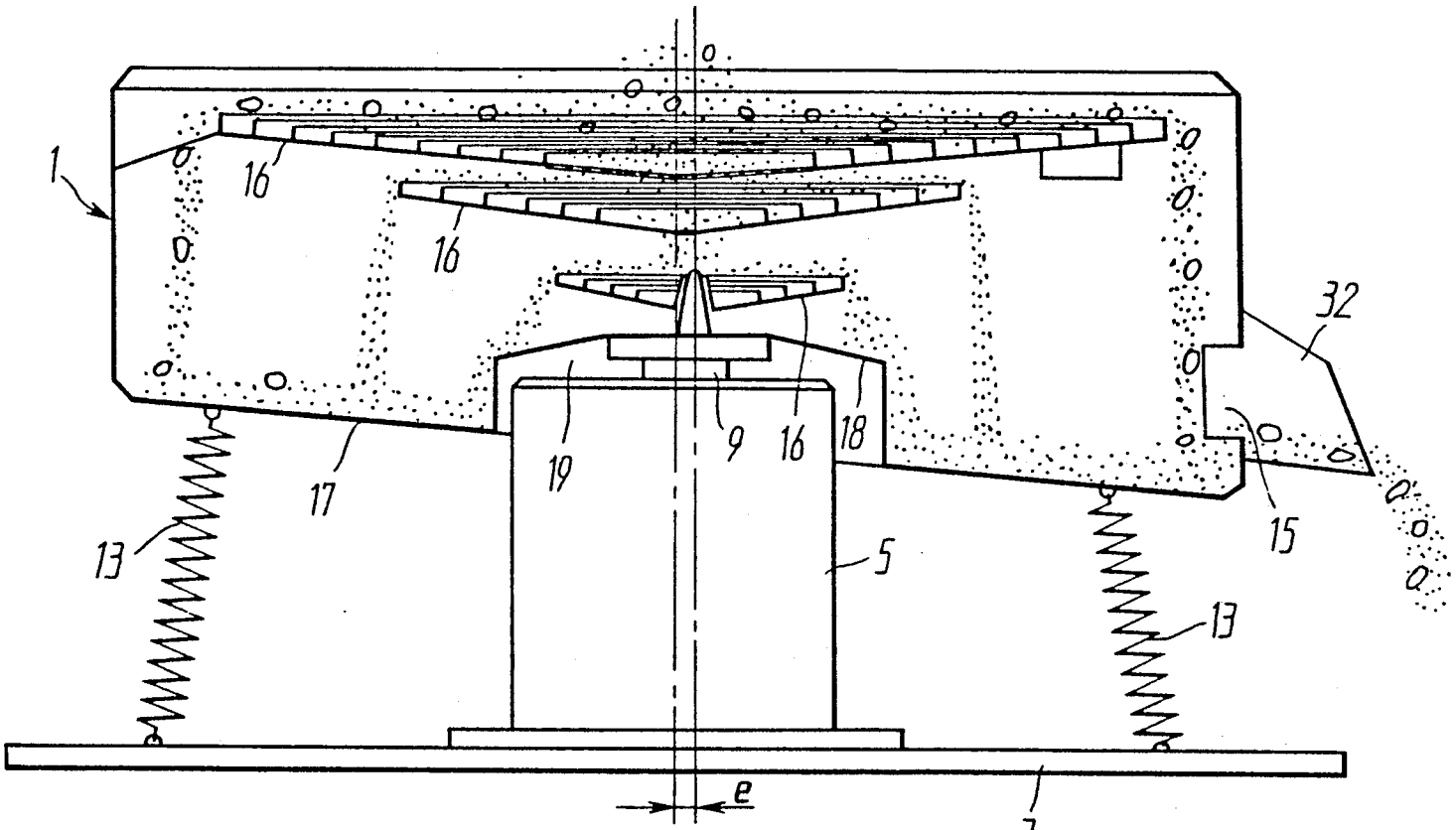
FIG. 4 shows the same with tapered trays secured in the central part of the housing.
Figure 5:
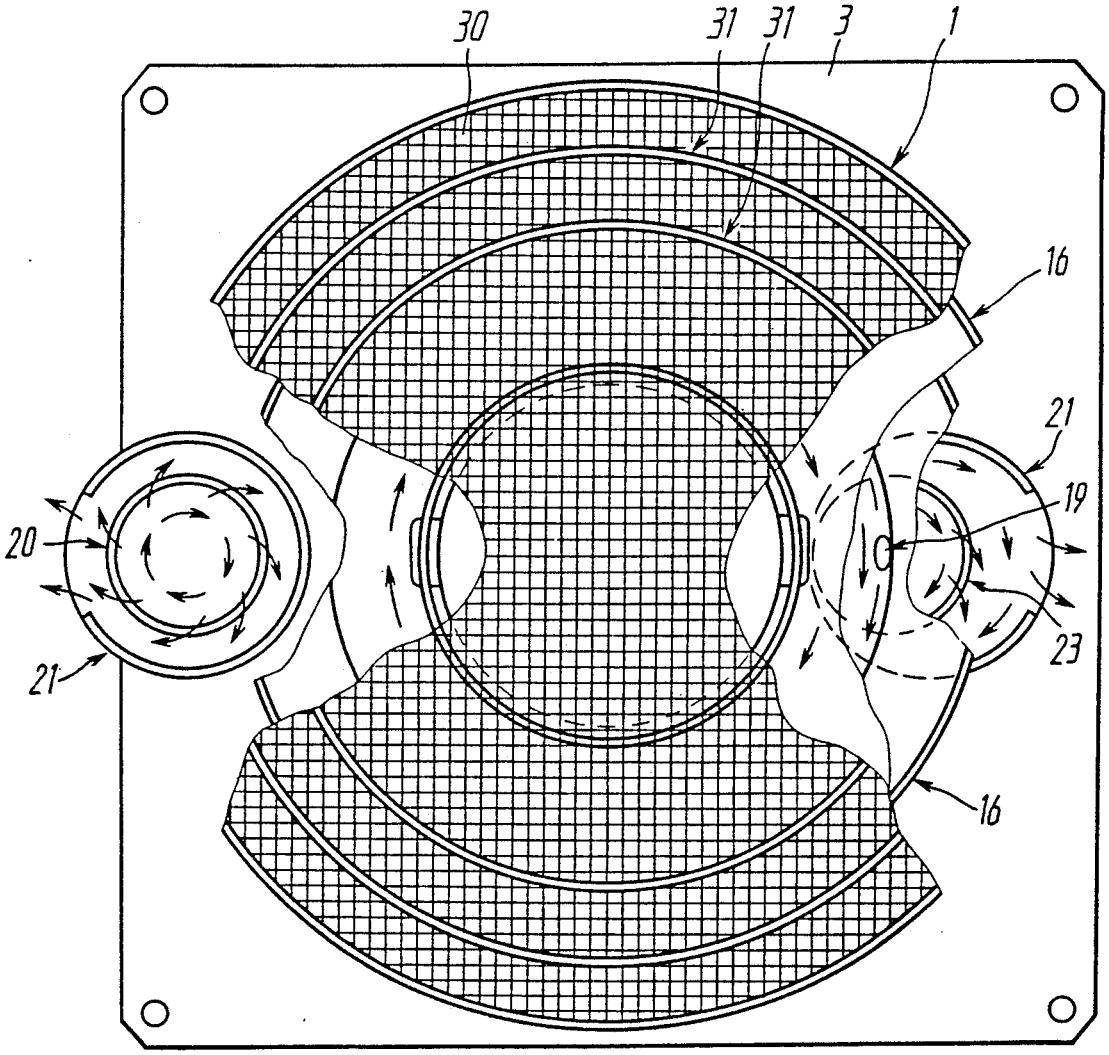
FIG. 5 is a top view of the concentrator shown in FIG. 1 with partially cut-away sections.

The tapered separating trays 16 are secured in a stepwise fashion on the side wall of the cylindrical housing 14, as shown in FIG. 3, or at the convex central portion 18, as seen best in FIGS. 1, 2, 4.

Due to that the proposed concentrator operates on the principle of gravity and executes jolt-like motions as it travels about the circle, the gangue is carried by water over the edges of the trays 16 to fall onto the bottom 17 of the housing 14 and be evacuated through the discharge hole 15 from the housing, after which it is conveyed through a finishing tray 20 to an end tray 21.

The central portions of the separating trays 16 have by-pass ports 22 of a flow area decreasing from the upper tray to the lower tray, i.e., $S > S_1$, where S is the flow area of the port 22 of the upper tray 16, whereas $S_1$ is the flow area of the port 22 of the lower tray 16.

Positioned under the lower separating tray 16 to underlie its by-pass port 22 having an outlet to the bottom 17 of the housing 14, such as through a pipe (as shown in FIGS. 2, 3) extending to the discharge hole 15 of the housing is an additional tray 23 intended to finish the concentrate. Arranged under the additional tray 23 is the end tray 21. The end trays 21 are attached to the housing 14 by brackets 24.

The flexible rods 13 are secured immediately to the housing 14 of the beneficiating member 1 (FIG. 4), or to the trays 21, as shown in FIGS. 1 to 3.

Figure 6:
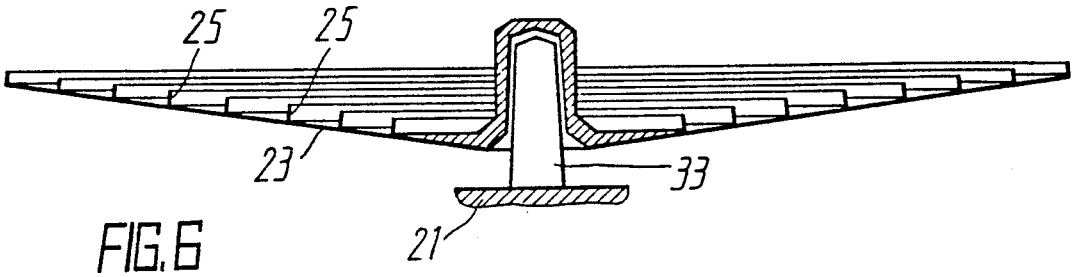
FIG. 6 shows an additional tray of the proposed concentrator.
Figure 7:
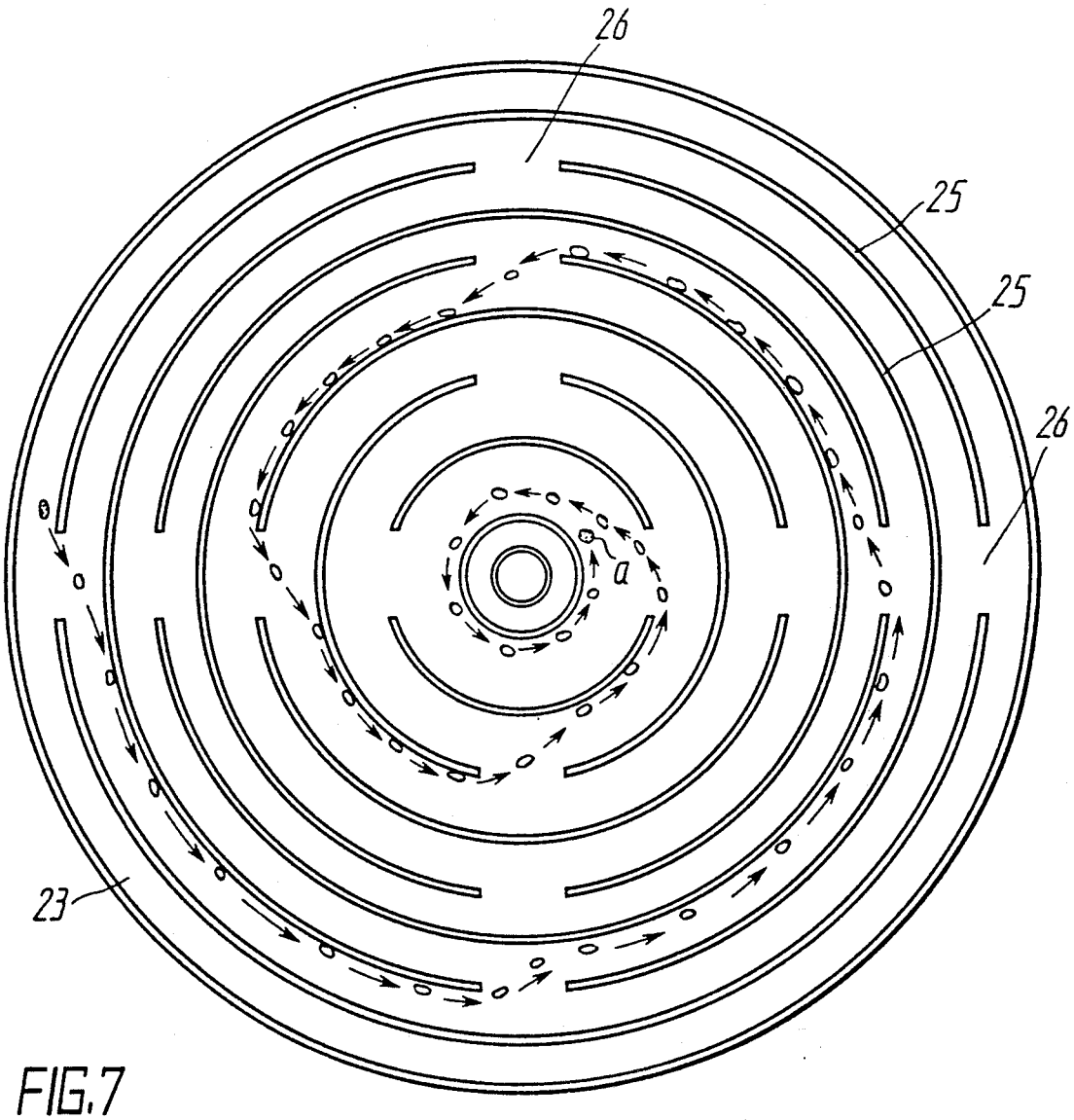
FIG. 7 is a top plan view of the concentrator shown in FIG. 6.

Each tray 16, 20, 23 (FIG. 6) is provided with circular riffles 25 with ports 26 (FIG. 7), the ports 26 in the riffles being offset relative to the adjacent riffles, whereby particles of metal settled on the tray are caused by the jolt-like motions of the tray to move along the riffles 25 through their ports 26 closer to the centre of the tray.

In order to liquify the material escaping through the by-pass ports 22 (FIGS. 2 and 3) of the trays 16 or the discharge hole 15 of the bottom 17 of the housing 14, the concentrator has one or two mixing chambers 27. The mixing chamber 27 is attached to the bottom 17 of the housing 14, and is arranged over the tray 20, as shown in FIG. 2, or over the tray 20 and tray 23, as shown in FIG. 3.

The mixing chamber 27 has an outlet hole 28 and communicates with the interior of the housing 14 through a perforated tube 29 built into the bottom 17 of the housing 14.

Provided above the upper separating tray 16 is a mesh 30 (FIGS. 1, 2, 5) onto which the material being treated is fed. Ribs 31 are secured on the mesh 30 to hold the coarse fraction of the material for a longer period of time on the mesh, and thus facilitate disintegration. The coarse fractions of the material are removed from the mesh 30 and evacuated from the housing 14 through a trough 32.

The proposed concentrator operates in the following manner.

Rotation of the motor is transmitted via the belt transmission 11 and pulley 12 to the hollow shaft 7 accommodating eccentrically the shaft 9 carrying the beneficiating member 1 travelling about a circle of a radius equal to the eccentricity.

The beneficiating member 1 is held against rotation by the flexible rods 13, and executes during the circular travel jolt-like motions.

The material in the form of a pulp is conveyed to the mesh 30, where under the action of jolt-like motions of the beneficiating member 1 it is disintegrated, and the fractions exceeding the size of the mesh cells are removed through the trough 32, whereas fine fractions enter the upper tapered separating tray 16.

Gravity separation of the material takes place in the tray 16. Fine fractions are moved from the tray 16 over its edge to fall onto the bottom 17 of the housing due to the stepwise arrangement of the underlying trays. Gangue accumulated at the bottom 17 is caused to move under the action of the jolt-like motions of the housing 14 toward the discharge hole 15 or to the trough 32 to be evacuated from the housing. If the mixing chamber 27 is provided under the discharge hole 15, as shown in FIG. 2, the gangue is forced by water conveyed through the perforated tube 29 to enter the finished concentrate tray 20, where it is additionally separated into fractions, whereas the material brought thereto with the gangue concentrates in the central part of the tray 20 thanks to the provision of the riffles 25 and ports 26 in these riffles, the gangue and water tending to flow over the edge to the end tray 21 to be evacuated therefrom.

Heavy fractions of the material are acted upon the jolt-like motions of the beneficiating member 1 in the upper tray 16 to move along the riffles 25 and pass through the ports 26 thereof to the central portion of the tray 16 to flow further through the by-pass ports 22 and enter the underlying tray 16, where they are subjected to additional separation into fractions in the aforedescribed manner. From the lower tray 16 the concentrated material moves along the riffles 25 through ports 26 to accumulate in the central part of the tray, and flow through the discharge hole 15 to the mixing chamber 27 (FIG. 3) and therefrom to the additional tray 23.

In the additional tray 23, as in the tray 16, the beneficiated material is concentrated in its central portion, whereas water and fine gangue flow over the edge of the tray 23 to the end tray 21 underlying the tray 23. Each of the trays 20 or 23 is freely mounted on a rod 33 (FIGS. 2, 3, 6) secured on the end tray 21. Such an arrangement allows to remove the tray 20 or 23, as the need arises, and clean these trays of the concentrated material.

INDUSTRIAL APPLICABILITY

The invention can be used with success for processing samples of gravel deposits, for processing concentrates of ore washing equipment and dredges, and for small-scale mining of gold, platinum, silver, and other metals and minerals of a density exceeding 5 g/cm$^3$.

I claim:

1. A concentrator for beneficiating minerals comprising a base with a hub, a beneficiating member with a discharge hole, and a drive mechanisms including a hollow drive shaft journalled in bearings in said hub of the base in which a shaft of the beneficiating member is arranged with an eccentricity in bearings to travel about a circle of a radius equal to the eccentricity, characterized in that the beneficiating member has a cylindrical housing with tapered separating trays which are fixedly mounted inside the cylindrical housing, one under the other, and having by-pass ports having flow areas decreasing from the upper to the lower tray, flexible rods connecting the cylindrical housing to the base.

2. A concentrator as claimed in claim 1, characterized in that an additional tray is connected to the cylindrical housing of the beneficiating member under upper the lower separating tray.

3. A concentrator as claimed in claim 1, characterized in that the tapered separating trays are arranged stepwise in the cylindrical housing.

4. A concentrator as claimed in claim 3, characterized in that the central part of the bottom of the cylindrical housing is concave toward the inside of the housing to define a cavity accommodating said drive mechanism therein.

5. A concentrator as claimed in claim 3, characterized in that the trays are provided with circular riffles having ports offset relative to the ports of the adjacent riffles.

6. A concentrator as claimed in claim 2, characterized in that connected to the bottom of the cylindrical housing above the additional tray is a mixing chamber having an outlet port and communicating with the interior of the housing through its discharge hole, and a perforated tube accommodated inside the housing.

* * * * *